US005248581A

United States Patent [19]

Nakayama et al.

[11] Patent Number: 5,248,581

[45] Date of Patent: Sep. 28, 1993

[54] TONER FOR ELECTROPHOTOGRAPHY

[75] Inventors: Koji Nakayama; Nobuharu Matubayashi; Takayuki Sano, all of Shizuoka, Japan

[73] Assignee: Tomoegawa Paper Co., Ltd., Tokyo, Japan

[21] Appl. No.: 794,411

[22] Filed: Nov. 18, 1991

[30] Foreign Application Priority Data

Nov. 22, 1990 [JP] Japan ..... 2-320259

[51] Int. Cl.[5] ..... G03G 9/097; G03G 9/107

[52] U.S. Cl. ..... 430/106.6; 430/110

[58] Field of Search ..... 430/106.6, 110

[56] References Cited

U.S. PATENT DOCUMENTS 4,395,485 7/1983 Kashiwagi et al. ..... 430/110 X

FOREIGN PATENT DOCUMENTS 135855 10/1980 Japan ..... 430/110
144437 11/1981 Japan ..... 430/110
211763 12/1983 Japan ..... 430/110
86566 5/1985 Japan ..... 430/106.6
209539 9/1987 Japan ..... 430/110
195659 8/1988 Japan ..... 430/110

*Primary Examiner*—Roland Martin
*Attorney, Agent, or Firm*—Wenderoth, Lind & Ponack

[57] ABSTRACT

A toner for electrophotography, which is obtained by attaching fine particles, each of which is formed by coating a core particles, e.g., metal oxide powders, ceramics, inorganic particles or resin particles, with a long-chain fatty acid metal salt to a surface of each of toner particles. The present toner gives an excellent image without causing any phenomenon of white spot within character, and the image formed is free from any fog and black speckle in an image background portion.

4 Claims, No Drawings

TONER FOR ELECTROPHOTOGRAPHY

FIELD OF THE INVENTION

The present invention relates to a toner for electrophotography.

PRIOR ART OF THE INVENTION

A conventional method of development with an electrostatic latent image and a toner is generally classified into a developing method using a two-component developer composed mainly of a toner and a carrier and a developing method using one-component developer containing a toner alone. There have been so far various proposals concerning these developing methods.

In any of these developing methods, an image formed of a toner on the latent image on a photosensitive drum is transferred to a sheet which is tightly in contact with the photosensitive drum. The transfer is carried out by a method using an electrostatic force, adhesion strength, heat, a solvent, pressure, or the like. An image formed of a magnetic toner can be transferred by a magnetic transfer method. A method using an electrostatic force has been generally put to practical use. In this case, the sheet to which an image is transferred can be selected from paper, an insulated film and a metal sheet.

Examples of the method using an electrostatic force are (1) a corona transfer method, (2) an electrically conductive roller transfer and (3) dielectric roller transfer method.

In the electrostatic transfer, an image formed of a toner on a photosensitive drum is transferred to a transfer paper sheet by irradiating the toner with a corona ion having a reversed polarity to the toner from the reverse side of the transfer paper sheet. The transfer starts when the coulomb force between a toner charge and the corona ion surpasses a force between the photosensitive drum and the toner charge. It is the most desirable to effect hundred percent transfer of an image formed of a toner on the photosensitive drum. However, the best transfer efficiency that can be actually achieved is about 90 percent.

In recent years, a high image quality has been strongly required, and the function of a copying machine is variously devised to obtain a faithful transfer image. However, even an excellent image formed of a toner on the photosensitive drum is liable to be impaired in a transfer process to cause an image defect. For example, a central portion of a character image remains untransferred on the photosensitive drum, and only an outline of the character image is transferred to a transfer paper sheet. That is, a phenomenon of white spot within a character takes place.

The above white spot phenomenon often occurs in an image of a line or a dot having a relatively small area, and it is scarely observed in a solid portion having a large area. The mechanism of the phenomenon of white spot in character is not fully clear. However, the white spot in character is presumably caused due to a failure in adhesion between a transfer paper sheet and a toner. That is, it is considered that an image of a line shows the following phenomenon of white spot in character; The fringe portion of the line forming a latent image is developed with a large amount of a toner due to an edge effect of a latent image and therefore has a thicker toner layer, whereas the central portion of the line is developed with a small amount of a toner and has a thin toner layer. As a result, a transfer paper sheet can be intimately brought into contact with the fringe portion, and a toner can be transferred excellently. However, a gap is formed between the central portion and the transfer paper sheet, and the toner is not sufficiently transferred, or remains on a photosensitive drum.

It is known that the above phenomenon of white spot within a character occurs more frequently when the thickness of a transfer paper sheet is increased. The reason therefor is considered as follows. With an increase in the thickness of a paper sheet, it becomes harder, and the adherence between a drum and a transfer paper sheet decreases.

The above phenomenon of white spot within character has some relation to a relative humidity. The higher the relative humidity is, more frequently the phenomenon of white spot within character occurs. The cause for such a phenomenon of white spot within character is considered as follows. With an increase in a water content, the electric resistance of a paper sheet decreases, and as a result, the transfer efficiency decreases.

SUMMARY OF THE INVENTION

It is an object of the present invention to provide a toner for electrophotography, which has excellent transfer properties and gives an excellent image without causing any phenomenon of white spot within character.

It is another object of the present invention to provide a toner for electrophotography, which has excellent charge characteristics, which gives excellent image resolution and excellent sharpness, and which is free from any fog and black speckles in an image background portion.

The above objects and advantages of the present invention are achieved by a toner for electrophotography, which is obtained by attaching fine particles to a surface of each of toner particles, each of the fine particles being formed by coating a core particle with a long-chain fatty acid metal salt.

DETAILED DESCRIPTION OF THE INVENTION

The toner of the present invention is characterized in that fine particles coated with a long-chain fatty acid metal salt is attached to a toner particle surface.

The long-chain fatty acid metal salt is generally called metallic soap, and used in a mold-releasing agent, a surface lubricant, a waterproofing agent and a dispersant. When this long-chain fatty acid metal salt is attached to a toner particle surface, the long-chain fatty acid metal salt is present in an interface between a photosensitive drum and toner particles used for development. Therefore, the long-chain fatty acid metal salt improves the lubricity of the toner from the photosensitive drum, and produces better transfer efficiency of the toner.

For the above-described purpose, there is known a method in which a long-chain fatty acid metal salt is attached to a toner particle surface, or added to a toner during the preparation of the toner by melt-kneading. In these methods, the lubricity of a toner from a photosensitive drum is improved and the transfer efficiency of the toner is also improved as described above, since the long-chain fatty acid metal salt is exposed on a toner particle surface. For this reason, a transfer failure which causes the phenomenon of white spot within a character can be overcome.

However, when the long-chain fatty acid metal salt is attached to a toner particle surface, the charge characteristics of the toner itself are sometimes affected. That is, the following problem occurs. When a toner is charged under friction with a charging member, the long-chain fatty acid metal salt exposed on the toner particle surface impairs the charging properties of the toner, and no sufficient charge can be obtained. And, insufficient charge of the toner causes image defects such as a failure in reproduction of a fine line, scattering around a fringe portion of a character and fogging. Further, the long-chain fatty acid metal salt itself has high cohesive strength and is liable to form coarse particles. Moreover, a toner and the long-chain fatty acid metal salt sometimes aggregate to form coarse particles. Such coarse particles formed adhere to a photosensitive drum to show black speckles. The above problem has necessitated a method of attaching the long-chain fatty acid metal salt to a toner particle surface so that no image defects occur. To overcome the above problem, it is required to attach fine particles of the long-chain fatty acid metal salt to a toner particle surface as uniformly as possible.

In the present invention, core particles are surface-coated with the long-chain fatty acid metal salt, and the resultant fine particles are attached to a toner particle surface. In this manner, the long-chain fatty acid metal salt can be attached to a toner particle surface uniformly, and neither an aggregate of the long-chain fatty acid acid metal salt nor an aggregate of a toner and the long-chain fatty acid metal salt is formed. Further, since the above fine particles are attached to a toner particle surface, there can be obtained a toner having remarkably superior fluidity.

As the above core particles to be surface-coated with the long-chain fatty acid metal salt, preferred are those having a smallest possible diameter. The diameter of the core particles is generally 0.01 to 1 μm, preferably 0.01 to 0.5 μm, more preferably 0.01 to 0.3 μm.

The material for the core particles is not specially limited. The material for the core particles may be selected from metal oxide powders formed of silica, alumina, titanium oxide, magnesium oxide, calcium oxide, iron oxide, magnetite and ferrites; ceramics such as silicon nitride and aluminum nitride; inorganic particles formed of carbon black, calcium sulfate, calcium carbonate and sodium glass; and resin particles formed of a polyacetal resin, an epoxy resin, an acrylic resin, a styrene resin, polystyrene resin and a polypropylene resin.

The long-chain fatty acid constituting the long-chain fatty acid metal salt may be linear or branched, and it may be a saturated or unsaturated fatty acid. The long-chain fatty acid generally has a main chain having 7 to 31 carbon atoms, preferably 11 to 28 carbon atoms. The long-chain fatty acid is selected from saturated fatty acids such as caprylic acid, capric acid, undecylic acid, lauric acid, myristic acid, palmitic acid, stearic acid, behenic acid, montanic acid and lacceric acid; and unsaturated fatty acids such as oleic acid, erucic acid, sorbic acid and linoleic acid.

The metal constituting the long-chain fatty acid metal salt is selected from aluminum, zinc, calcium, magnesium, manganese, cobalt, nickel, chromium, iron, barium, lead, cadmium, tin, lithium and copper.

Examples of the long-chain fatty acid metal salt are zinc laurate, cadmium laurate, lithium laurate, magnesium palmitate, nickel palmitate, zinc stearate, aluminum stearate, barium stearate, lithium stearate, zinc behenate, zinc montanate, aluminum montanate, zinc oleate, cobalt oleate, lithium oleate, barium linoleate and zinc linoleate.

The core particles are surface-coated with the long-chain fatty acid metal salt by a method in which the core particles are charged into a suitable agitator, a solution of the long-chain fatty acid metal salt in a solvent is added dropwise or sprayed to surface-coat the core particles uniformly, and then the resultant fine particles are dried in a dryer. When aggregates of the fine particles are formed, the aggregates are milled or pulverized as required.

The core particles are also surface-coated with the long-chain fatty acid metal salt by a wet method, in which the core particles are dispersed in a metal hydroxide aqueous solution, the long-chain fatty acid is added to the dispersion to react it with the metal hydroxide. The core particles of titanium oxide or silicon oxide can be produced by a wet method. Therefore, the core particles of titanium oxide or silicon oxide coated with the long-chain fatty acid metal salt may be prepared by adding a metal hydroxide and the long-chain fatty acid to titanium oxide, etc., and reacting these components.

The amount of the fine particles obtained by surface-coating the core particles with the long-chain fatty acid metal salt is used preferably in an amount of 0.01 to 15 parts by weight per 100 parts by weight of toner particles. The amount of the long-chain fatty acid metal salt for use per 100 parts by weight of the core particles is 0.01 to 100 parts by weight. When the amount of fine particles is more than 15 parts by weight, blocking of the toner is liable to occur. When it is less than 0.01 parts by weight, no effect of attached fine particles is obtained.

A binder resin for the toner particles used in the present invention is selected from generally used toner binders such as a styrene resin, an acrylic resin, a polyester resin, an epoxy resin, a urethane resin, a polyamide resin, polyethylene, an acrylic acid resin, a ketone resin and a phenolic resin. The styrene resin is produced from styrene-based monomers such as styrene, methylstyrene, chlorostyrene and vinyltoluene. The acrylic resin is produced from acrylic acid or methacrylic acid ester-based monomers such as methyl acrylate, ethyl acrylate, n-butyl acrylate, dodecyl acrylate, 2-ethylhexyl acrylate, methyl methacrylate, ethyl methacrylate, n-butyl methacrylate, n-octyl methacrylate, dodecyl methacrylate and stearyl methacrylate.

The above resins may be used alone or in combination. The resin combination and the molecular weights of the resin(s) to be employed can be suitably determined depending upon the softening point and glass transition temperature of a desirable final polymer product.

The toner particles used in the present invention may contain other additives such as a colorant and a charge regulator. When the toner to which the present invention is applied is a magnetic toner, magnetic materials such as magnetite and ferrite may be used.

In the present invention, the fine particles surface-coated with the long-chain fatty acid metal salt are attached to the toner particles by means of a generally used agitator such as a crushing agitator, a turbine-applied agitator and a Henschel mixer. Further, there may be also used known surface-modifying apparatus such as "Mechanofusion system" (supplied by Hosokawa Micron Corporation) and "Nara hybridization system" (supplied by Nara Machinery Co., Ltd.) to attach the fine particles more fixedly to the toner particles.

The toner for electrophotography according to the present invention is formed by attaching fine particles of which the surfaces are coated with a long-chain fatty acid metal salt to toner particle. Therefore, the toner of the present invention exhibits excellent fluidity, and is free from aggregation of the toner particles. Therefore, the toner of the present invention can exhibit excellent transferability and give an image which is free from any phenomenon of white spot within character.

PREPARATION OF FINE PARTICLES COATED WITH A LONG-CHAIN FATTY ACID METAL SALT

(a) Preparation of Fine Particles A Coated with a Long-Chain Fatty Acid Metal Salt 100 Parts of core particles of titanium oxide (average particle diameter 0.2 μm) were charged into a super mixer, and a solution prepared by diluting 50 parts by weight of zinc stearate with 100 parts by weight of benzene was sprayed to the core particles. The core particles were agitated to coat the zinc stearate on surfaces of the core particles uniformly. Thereafter, the coated core particles were dried in a dryer, milled with a jet mill to crush aggregates of the coated core particles into fine particles, whereby fine particles A coated with a long-chain fatty acid metal salt, used in the present invention, were obtained. The amount of the zinc stearate coated on the core particles was 50 parts by weight per 100 parts by weight of the core particles.

(b) Preparation of Fine Particles B Coated with a Long-Chain Fatty Acid Metal Salt 100 Parts of core particles of titanium oxide (average particle diameter 0.2 μm) were charged into a super mixer, and a solution prepared by diluting 50 parts by weight of aluminum stearate with 100 parts by weight of petroleum ether was sprayed to the core particles. The core particles were agitated to coat the aluminum stearate on surfaces of the core particles uniformly. Thereafter, the coated core particles were dried in a dryer, milled with a jet mill to crush aggregates of the coated core particles into fine particles, whereby fine particles B coated with a long-chain fatty acid metal salt, used in the present invention, were obtained. The amount of the aluminum stearate coated on the core particles was 45 parts by weight per 100 parts by weight of the core particles.

Preparation of Fine Particles C Coated with a Long-Chain Fatty Acid Metal Salt 100 Parts of core particles of titanium oxide (average particle diameter 0.2 μm) were charged into a super mixer, and a solution prepared by diluting 50 parts by weight of zinc laurate with 100 parts by weight of petroleum ether was sprayed to the core particles to coat the zinc laurate on surfaces of the core particles uniformly. Thereafter, the coated core particles were dried in a dryer, milled with a jet mill to crush aggregates of the coated core particles into fine particles, whereby fine particles C coated with a long-chain fatty acid metal salt, used in the present invention, were obtained. The amount of the zinc laurate coated on the core particles was 50 parts by weight per 100 parts by weight of the core particles.

(d) Preparation of Fine Particles D Coated with a Long-Chain Fatty Acid Metal Salt The preparation of fine particles C was repeated except that the aluminum stearate was replaced with 100 parts by weight of zinc montanate, whereby fine particles D coated with a long-chainh fatty acid metal salt, used in the present invention, were obtained. The amount of the zinc montanate coated on the core particles was 90 parts by weight per 100 parts by weight of the core particles.

(e) Preparation of Fine Particles E Coated with a Long-Chain Fatty Acid Metal Salt The preparation of the fine particles A was repeated except that the titanium oxide was replaced with silicon oxide and that the zinc stearate was replaced with lithium oleate, whereby fine particles E coated with a long-chain fatty acid metal salt were were obtained. The amount of the lithium oleate coated on the core particles was 40 parts by weight per 100 parts by weight of the core particles.

EXAMPLES 1-28

The mixing ratio of components for toners and the mixing ratios of components for magnetic carriers, used in Examples, are as follows.

(1) Toner Particles

1) Magnetic toner

Styrene-acrylic acid copolymer (from styrene and 2-ethylhexyl acrylate, trade name UNI 3000, supplied by Sanyo Chemical Industries Ltd.) 100 parts by weight:

A low-molecular-weight polypropylene resin (trade name, Viscol 660P, supplied by Sanyo Chemical Industries Ltd) 2 parts by weight:

Magnetite (trade name EPT-1100, supplied by Toda Kogyo Corp.) 50 parts by weight:

Metal complex of salicylic acid derivative (chromium 3,5-di-tert-butylsalicylate, trade name Bontron EX, supplied by Orient Chemical Industries Ltd.) 2 parts by weight:

2) Nonmagnetic toner

Polyester resin (trade name HP-320, supplied by the Nippon Synthetic Chem. Ind. Co., Ltd) 90 parts by weight:

Low-molecular-weight polypropylene resin (trade name Viscol 330P, supplied by Sanyo Kasei) 3 parts by weight:

Carbon black (#30, supplied by Mitsubishi Chemical Industries Ltd.) 5 parts by weight:

Nigrosine dye (trade name Bontron EX, supplied by Orient Chemical Industries Ltd.) 2 parts by weight:

(2) Magnetic Carrier

Ferrite core material: Average particle diameter 50 μm, saturated magnetization 65 emu/g (trade name F141-2535, supplied by Powder Tech Co., Ltd.).

The above components for each of the magnetic toner and the nonmagnetic toner were respectively mixed with a super mixer, melted, kneaded, milled and classified to give toner particles having an average particle diameter of 12μ. Then, silica (R972, supplied by Nippon Aerosil Corporation) and the above fine particles A, B, C, D or E coated with a long-chain fatty acid metal salt were added to, and mixed with, the above toner particles in the proportions shown in Table 1 (Nos. 1 to 28) to give toners of the present invention. The toners containing the magnetic toner were mixed with the above magnetic carrier in a toner/magnetic carrier weight ratio of 20/80 to prepare developers. The toners containing the nonmagnetic toner were mixed with the above magnetic carrier in a toner/magnetic carrier weight ratio of 5/95 to prepare developers. Table 1 shows the results of evaluation of the developers.

TABLE 1

| Example No. | Additives* | | | White spot within character | Image density | Fog density | Black speckles |
|---|---|---|---|---|---|---|---|
| | | | (Magentic toners) | | | | |
| 1 | fine particles A | 0.1% | R972 0.5% | B | 1.42 | 0.48 | No |
| 2 | " | 0.5 | " | B | 1.41 | 0.49 | No |
| 3 | " | 1.0 | " | A | 1.40 | 0.45 | No |
| 4 | " | 2.0 | " | A | 1.40 | 0.50 | No |
| 5 | fine particles B | 0.1 | " | B | 1.42 | 0.52 | No |
| 6 | " | 0.5 | " | B | 1.41 | 0.52 | No |
| 7 | " | 1.0 | " | A | 1.41 | 0.57 | No |
| 8 | " | 2.0 | " | A | 1.40 | 0.42 | No |
| 9 | fine particlcs C | 0.5 | " | B | 1.40 | 0.57 | No |
| 10 | " | 2.0 | " | A | 1.40 | 0.50 | No |
| 11 | fine particles D | 0.5 | " | B | 1.41 | 0.48 | No |
| 12 | " | 2.0 | " | A | 1.40 | 0.44 | No |
| 13 | fine particles E | 0.5 | " | B | 1.42 | 0.58 | No |
| 14 | " | 2.0 | " | A | 1.40 | 0.51 | No |
| | | | (Nonmagnetic toners) | | | | |
| 15 | fine particles A | 0.1 | " | B | 1.42 | 0.46 | No |
| 16 | " | 0.5 | " | A | 1.42 | 0.46 | No |
| 17 | " | 1.0 | " | A | 1.41 | 0.52 | No |
| 18 | " | 2.0 | " | A | 1.40 | 0.48 | No |
| 19 | fine particles B | 0.1 | " | B | 1.42 | 0.44 | No |
| 20 | " | 0.5 | " | 8 | 1.42 | 0.43 | No |
| 21 | " | 1.0 | " | A | 1.40 | 0.50 | No |
| 22 | " | 2.0 | " | A | 1.40 | 0.51 | No |
| 23 | fine particles C | 0.5 | " | B | 1.41 | 0.55 | No |
| 24 | " | 2.0 | " | A | 1.40 | 0.57 | No |
| 25 | fine particles D | 0.5 | " | B | 1.41 | 0.53 | No |
| 26 | " | 2.0 | " | A | 1.40 | 0.46 | No |
| 27 | fine particles E | 0.5 | " | B | 1.41 | 0.51 | No |
| 28 | " | 2.0 | " | A | 1.41 | 0.54 | No |

*Amount of additive: percent based on the weight of the toner particles.

COMPARATIVE EXAMPLES 1-9

Toners were prepared by attaching the additives of which the names and amounts are shown in Table 2 (Nos. 1 to 9) to the surfaces of the same nonmagnetic toner as that used in Examples 15 to 28. The resultant toners were respectively mixed with the same magnetic carrier as that used in Examples 15 to 28 in the toner/-magnetic carrier mixing ratio of 5/95 to prepare developers. Table 2 shows the results of evaluation of the developers.

TABLE 2

| Comparative Example No. | Additives | | | White spot within character | Image density | Fog density | Black speckles |
|---|---|---|---|---|---|---|---|
| | | | (Nonmagnetic toners) | | | | |
| 1 | R972 0.5% | R25 0.5% | | X | 1.42 | 0.42 | No |
| 2 | " | T805 0.5 | | X | 1.42 | 0.46 | No |
| 3 | " | T805 1.0 | | X | 1.41 | 0.47 | No |
| 4 | " | T805 2.0 | | X | 1.40 | 0.54 | No |
| 5 | " | MT600BS 2.0 | | X | 1.40 | 0.48 | No |
| 6 | " | zinc stearate 0.1 | | A | 1.40 | 0.48 | X |
| 7 | " | aluminum stearate 0.1 | | A | 1.40 | 0.50 | X |
| 8 | " | zinc laurate 0.1 | | A | 1.41 | 0.45 | X |
| 9 | " | lithium oleate 0.1 | | A | 1.40 | 0.52 | X |

Notes:
1. P25 = hydrophilic titanium oxide (supplied by Nippon Aerosil Corporation)
2. T805 = hydrophobic titanium oxide (")
3. MT600BS = hydrophobic titanium oxide (supplied by TAYCA Corporation)

The developers prepared in Examples 1 to 28 and Comparative Examples 1 to 9 were evaluated as follows.

(a) The developers containing the magnetic toners were tested by making 30,000 copies with a copying machine (trade name JX9500, supplied by Sharp Corporation), and the developers containing the nonmagnetic toners were tested by making 30,000 copies with a copying machine (trade name JX9700, supplied by Sharp Corporation), at an ambient temperature of 23° to 25° C. at an ambient relative humidity of 65%. Concerning each of the above developers, the 30,000th sheet was evaluated as follows.

(b) White spot in character

Thirty i's printed on the 30,000th sheet were observed with a magnifying glass having a magnifying power of 10, and the i's which showed a white spot in character were counted. The ratings of the evaluation are as follows.

| Symbol | The number of i's having a white spot |
|---|---|
| A | 0 |
| B | 1-6 |
| C | 7-12 |
| X | 13-30 |

(c) Image density

Measured with a Macbeth densitometer (supplied by Macbeth).

(d) Black speckle

| Symbol | Evaluation |
|---|---|
| No | Not recognized |
| X | recognized |

(e) Fog density

The white ground of the copy sheet was measured for a fog density with a Hunter whiteness measuring apparatus (supplied by Nippon Densyoku Kogyo Company)

(f) Copy sheet

Igepa copy sheets having a basic weight of 80 g/m$^2$ (supplied by Igepa Plus) were used.

RESULTS OF EVALUATION

In Examples using the developers prepared by adding fine particles coated with a long-chain fatty acid metal salt to the toners, excellent images with no phenomenon of white spot in character were obtained.

In all the Comparative Examples which used the developers prepared by adding particles coated with no long-chain fatty acid metal salt to the toners, a phenomenon of white spot in character occurred. In all the Comparative Examples which used developers prepared by directly adding a long-chain fatty acid metal salt to the toners, no phenomenon of white spot in character occurred. In this case, however, many black speckles were found on a white ground. These defects are due to formation of aggregates of a long-chain fatty acid metal salt and the toner.

What is claimed is:

1. A toner for electrophotography which comprises toner particles having fine particles attached to the surface thereof, the amount of the fine particles being 0.01 to 15 parts by weight per 100 parts by weight of the toner particles and the fine particles being core particles which are coated with 0.01 to 100 parts by weight per 100 parts by weight of a salt of a long-chain fatty acid and a metal selected from the group consisting of magnesium, calcium, zinc, aluminum, barium, manganese, cobalt, nickel, chromium, iron, lead, cadmium, copper and tin.

2. A toner according to claim 1, wherein the core particles are particles of at least one member selected from the group consisting of silica, alumina, titanium oxide, magnesium oxide, calcium oxide, iron oxide, magnetite, ferrites, silicon nitride, aluminum nitride, carbon black, calcium sulfate, calcium carbonate, sodium glass, a polyacetal resin, an epoxy resin, an acrylic resin, polystyrene resin and a polypropylene resin.

3. A toner according to claim 1, wherein the core particles have an average particle diameter of 0.01 to 1.0 μm.

4. A toner according to claim 1, wherein the long-chain fatty acid has a main chain having 7 to 31 carbon atoms.

* * * * *